US008712268B2

(12) United States Patent
Iwasaki

(10) Patent No.: US 8,712,268 B2
(45) Date of Patent: Apr. 29, 2014

(54) FIXING APPARATUS

(75) Inventor: Atsushi Iwasaki, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 171 days.

(21) Appl. No.: 13/287,024

(22) Filed: Nov. 1, 2011

(65) Prior Publication Data

US 2012/0121284 A1 May 17, 2012

(30) Foreign Application Priority Data

Nov. 11, 2010 (JP) ..... 2010-252471

(51) Int. Cl.
*G03G 15/20* (2006.01)

(52) U.S. Cl.
USPC ..... 399/67; 399/69; 399/328; 399/329

(58) Field of Classification Search
USPC ..... 399/38, 67–70, 107, 110, 122, 320, 399/328, 329, 406
See application file for complete search history.

(56) References Cited

U.S. PATENT DOCUMENTS

| | | | | |
|---|---|---|---|---|
| 7,668,494 | B2 * | 2/2010 | Kubo et al. | 399/328 |
| 8,295,753 | B2 * | 10/2012 | Kagawa | 399/329 |
| 2009/0245842 | A1 * | 10/2009 | Segawa | 399/69 |

FOREIGN PATENT DOCUMENTS

| | | | |
|---|---|---|---|
| CN | 1137125 | A | 12/1996 |
| CN | 1199187 | A | 11/1998 |
| CN | 1210287 | A | 3/1999 |
| CN | 101692161 | A | 4/2010 |
| JP | 2002072754 | A | 3/2002 |
| JP | 2003091212 | A | 3/2003 |
| JP | 2007-128037 | A | 5/2007 |
| JP | 2009192713 | A | 8/2009 |

* cited by examiner

*Primary Examiner* — Hoan Tran
(74) *Attorney, Agent, or Firm* — Canon USA Inc. IP Division

(57) ABSTRACT

A fixing apparatus is capable of executing a first fixing mode for performing fixing processing at a first pressing force and a second fixing mode for performing fixing processing at a second pressing force that is lower than the first pressing force. When a pressing force applied to a fixing nip portion is set to the second pressing force, all of a first heating member pattern on a heater is contained within a contact region between a belt member and the heater, and at least a portion of a second heating member pattern is disposed outside the contact region, so that consumed power is reduced.

6 Claims, 10 Drawing Sheets

HEATER 16
CROSS-SECTIONAL VIEW

HEATER 16
PLAIN VIEW

FIRST PRESSING MODE

SECOND PRESSING MODE

HEATER 50
PLAIN VIEW

FIRST PRESSING MODE

SECOND PRESSING MODE

HEATER 60
PLAIN VIEW

FIRST PRESSING MODE

SECOND PRESSING MODE

HEATER 65
PLAIN VIEW

HEATER 70
PLAIN VIEW

FIRST PRESSING MODE

SECOND PRESSING MODE

FIXING APPARATUS

BACKGROUND OF THE INVENTION

1. Field of the Invention

The present invention relates to a fixing apparatus used in an image forming apparatus such as a copying machine or a laser beam printer.

2. Description of the Related Art

An image forming apparatus such as an electrophotographic copying machine or a laser beam printer includes a fixing apparatus that fixes a toner image formed on a recording material by performing heating and pressing. The fixing apparatus is heated by employing a heat roller method that uses a cylindrical member which internally includes a halogen heater. Further, there recently is a film heating method which can save power in the fixing apparatus.

The fixing apparatus employing the film heating method includes a sliding nip portion (hereinafter referred to as an inner surface nip portion or a heat transfer nip portion) and a pressing nip portion (hereinafter referred to as a fixing nip portion). The sliding nip portion is formed by a cylindrical belt (hereinafter referred to as a fixing sleeve) that is based on a heat-resistant resin or metal, and a heating member that is made of ceramic or the like, and contact-slides to an inner surface of the fixing sleeve. The pressing nip portion is formed by a pressing member pressing via the fixing sleeve. The recording material carrying the toner image is held between and conveyed through the fixing nip portion, so that the toner image is fixed on the recording material. Since the fixing apparatus employing the film heating method intensively heats an area surrounding the fixing nip portion, power can be saved and wait time can be shortened (i.e., quick start) as compared to a fixing apparatus employing the heat roller method.

Further, there are various types of recording materials used in the image forming apparatus. Such recording materials to be used in the image forming apparatus include plain paper commonly used in an office, a medium in which a sheet is in folds, e.g., an envelope, and thin paper whose basis weight is 60 g/m$^2$ or less.

Japanese Patent Application Laid-Open No. 2007-128037 discusses a fixing apparatus in which a pressing force can be changed to correspond to various media such as an envelope or thin paper. However, if the pressing force is changed according to the type of media in the fixing apparatus employing the film heating method and including the fixing sleeve formed of a highly rigid member such as metal, a region width of the fixing nip portion becomes narrow when the pressing force is reduced. As a result, heat-transfer efficiency of the heating member becomes lowered due to narrowing of the region width in the inner surface nip portion. In other words, if the pressing force of the fixing apparatus employing the film heating method is reduced to prevent wrinkles to be generated in the envelope or prevent curling, the heat-transfer efficiency when fixing the image on the medium may be lowered.

SUMMARY OF THE INVENTION

The present invention is directed to a fixing apparatus capable of reducing power consumption when lowering a pressing force applied to a fixing nip portion and performing fixing processing.

According to an aspect of the present invention, a fixing apparatus includes a heater, a belt member to which the heater is in contact with on an inner circumferential surface, a back-up member configured to form a fixing nip portion with the heater via the belt member for performing fixing processing on a recording material, and a pressure adjustment mechanism configured to be capable of setting a pressing force to be applied to the fixing nip portion to a first pressing force and a second pressing force that is lower than the first pressing force, wherein the fixing apparatus is capable of executing a first fixing mode in which fixing processing is performed at the first pressing force and a second fixing mode in which fixing processing is performed at the second pressing force, and wherein the heater includes a first heating member pattern and a second heating member pattern, and if the first pressing force is set to the pressing force to be applied to the fixing nip portion, all of the first heating member pattern and the second heating member pattern are contained within a contact region between the heater and the belt member, and if the second pressing force is set to the pressing force to be applied to the fixing nip portion, all of the first heating member pattern is contained within the contact region and at least a portion of the second heating pattern is disposed outside the contact region.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

(1) Entire Configuration of a Multi-Color Image Forming Apparatus

Figure 1:
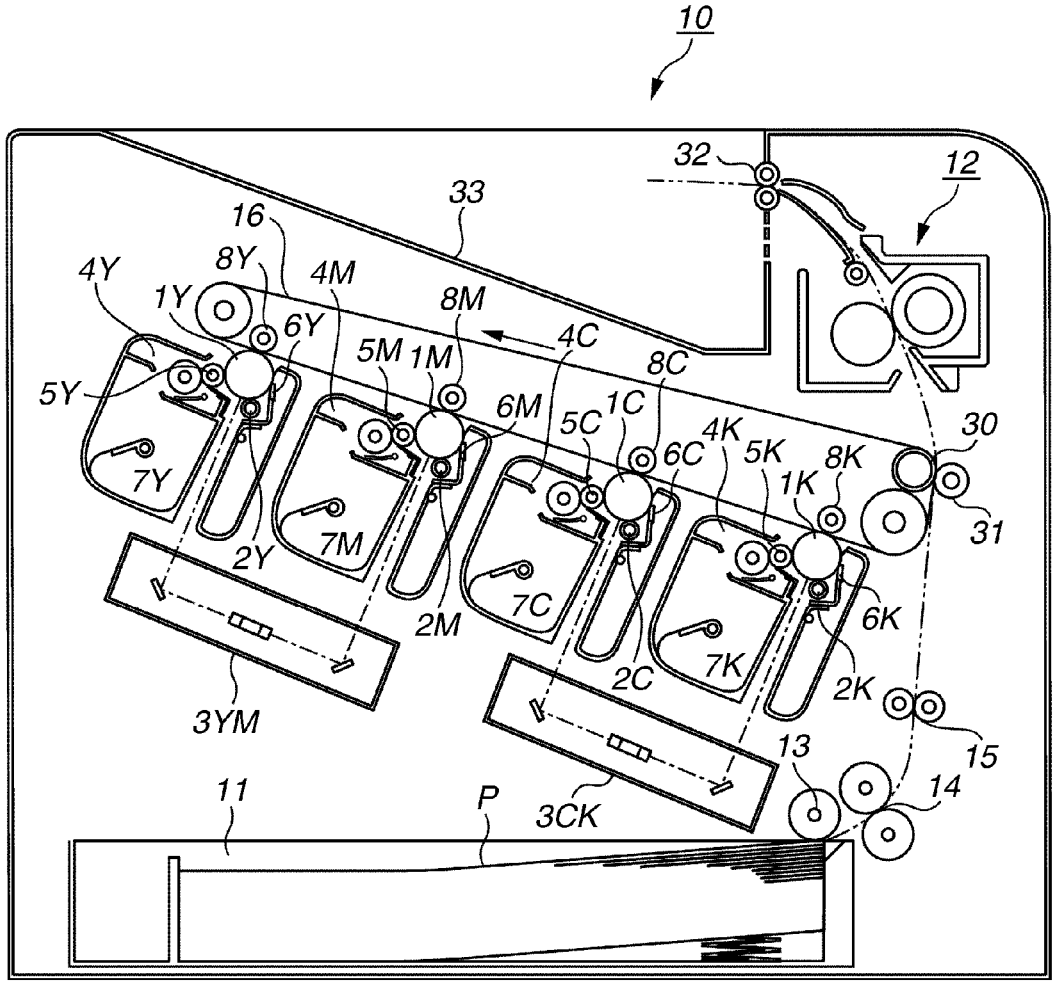
FIG. 1 is a schematic cross-sectional view illustrating an image forming apparatus according to a first exemplary embodiment.

The entire configuration of an image forming apparatus according to a first exemplary embodiment will be described below with reference to FIG. 1. FIG. 1 is a schematic cross-sectional view illustrating the entire configuration of a full-color laser beam printer (hereinafter referred to as a printer 10) that is an example of the image forming apparatus according to the present exemplary embodiment. According to the present exemplary embodiment, the full-color laser beam printer including a plurality of photosensitive drums will be described below. However, the present invention is not limited to this configuration. The present invention can be applied to a monochrome copying machine or printer including a single photosensitive drum.

Referring to FIG. 1, a cassette 11 which can be drawn out is stored in a lower portion of the printer 10. Recording materials P are stacked and contained in the cassette 11. A pick-up roller 13 feeds the recording materials P from the cassette 11. The recording materials P are then separated sheet-by-sheet by a feed-retard roller pair 14, and conveyed to a resist roller 15.

The printer 10 includes an image forming unit 7 in which image forming stations 7Y, 7M, 7C, and 7K corresponding to each of yellow, magenta, cyan and black colors respectively are arranged side by side.

The image forming unit 7 includes photosensitive drums 1Y, 1M, 1C, and 1K (hereinafter collectively referred to a photosensitive drum 1), i.e., image bearing members, and charging devices 2Y, 2M, 2C, and 2K that uniformly charges the surface of the photosensitive drum 1. Further, the image forming unit 7 includes developing devices 4Y, 4M, 4C, and 4K that attach toner to an electrostatic latent image on the photosensitive drum 1 and develop the image as the toner image. Furthermore, the image forming unit 7 includes primary transfer units 8Y, 8M, 8C, and 8K (hereinafter collectively referred to as a primary transfer unit 8) that transfer the toner image on the photosensitive drum 1 to an electrostatic transfer belt 29.

Scanner units 3YM and 3CK disposed below the image forming unit 7 emit a laser beam according to image information to form the electrostatic latent image on the photosensitive drum 1. Developing rollers 5Y, 5M, 5C, and 5K supply toner to the photosensitive drum 1, and cleaners 6Y, 6M, 6C, and 6K clean the photosensitive drum 1.

A toner image T transferred to the transfer belt 29 by the primary transfer unit 8 is transferred to the recording material P at a secondary transfer unit 31. The recording material P is then passed through a fixing apparatus 12, so that the toner image T is fixed on the recording material P. The recording material P is conveyed to and passes through a discharge roller pair 32, and discharged to a recording material stacking unit 33.

A sheet-passing width of the recording material P in the printer 10 according to the present exemplary embodiment is 76 mm to 297 mm in a direction perpendicular to a conveying direction (hereinafter referred to as a longitudinal direction). A sheet-passing reference in the printer 10 is a proximate center with respect to the direction perpendicular to the conveying direction of the recording material P (hereinafter referred to as center alignment).

(2) Fixing Apparatus

The fixing apparatus 12 according to the present exemplary embodiment will be described below with reference to FIG. 2. The fixing apparatus 12 according to the present exemplary embodiment employs the film-heating method, and a heating apparatus uses a rotatable pressing member driving method (i.e., tensionless type).

Figure 2:
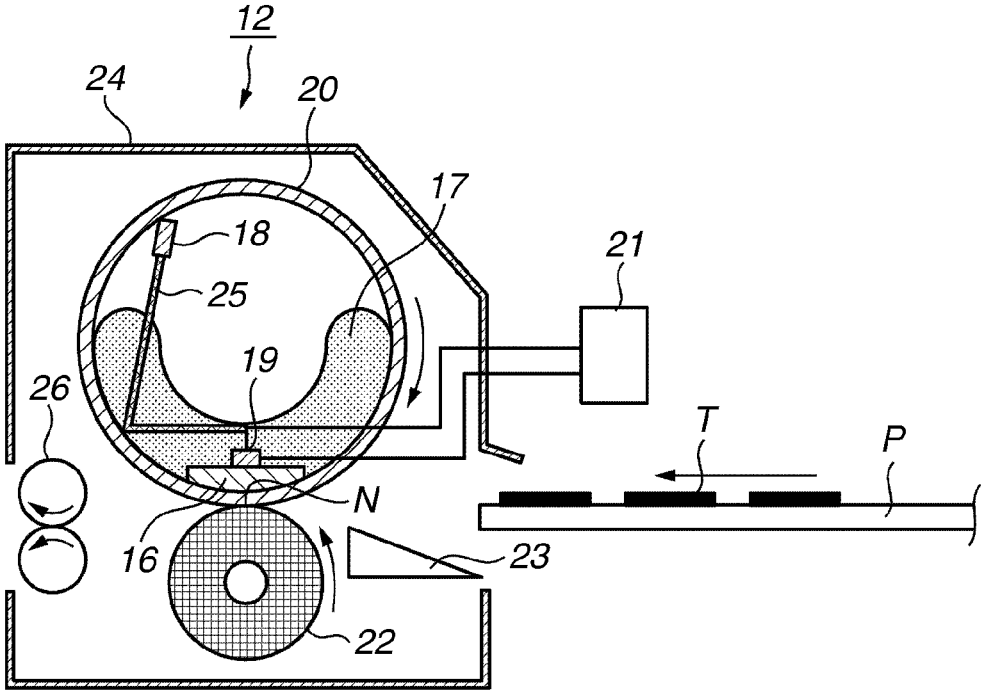
FIG. 2 is a schematic cross-sectional view illustrating a fixing apparatus according to the first exemplary embodiment.

Referring to FIG. 2, the fixing apparatus 12 includes a fixing sleeve 20 (i.e., a cylindrical belt member) to be described in detail below, and a pressing roller 22 (i.e., a back-up member). A heater holder 17 is a heat-resistant, rigid heater holding member whose cross-section has an approximate semicircular arc gutter shape. A heater 16 is disposed along a longitudinal direction of the heater holder 17 at a bottom side thereof. The fixing sleeve 20 is loosely and externally fitted on the heater holder 17. The heater 16 is a ceramic heater.

The heater holder 17 formed of highly heat-resistant liquid crystal polymer resin holds the heater 16 and guides the fixing sleeve 20. According to the present exemplary embodiment, Zenite 7755 (product name) which is manufactured by Dupont is used as the liquid crystal polymer. The upper usable temperature limit of Zenite 7755 is approximately 270° C.

A pressing roller 22 is manufactured by forming on a stainless steel core, a silicone rubber layer of approximately 3 mm thickness by injection molding, and covering with a tetrafluoroethylene-perfluoroalkyl vinyl ether (PFA) resin tube of approximately 40 μm thickness. According to the present exemplary embodiment, an outer diameter of the pressing roller 22 is 25 mm. Both ends of the core of the pressing roller 22 are mounted between far side and near side of side plates (not illustrated) of an apparatus frame 24 to freely rotate.

A fixing sleeve unit including the heater 16, the heater holder 17, and the fixing sleeve 20 is disposed above the pressing roller 22, so that the heater 16 is disposed facing downwards and parallel to the pressing roller 22. A pressing mechanism to be described below applies a force to both ends of the heater holder 17 towards the pressing roller 22 with a maximum force of 147 N (15 kgf) for one side, i.e., 294 N (30 kgf) total pressing force.

A fixing nip portion N of a predetermined width necessary for heat-fixing is thus formed by press-contacting the heater 16 onto the pressing roller 22 via the fixing sleeve 20. The pressing mechanism to be described below includes an automatic pressure changing mechanism (i.e., a pressure adjustment mechanism), and is capable of changing the pressing force according to the medium to be passed through.

An entrance guide 23 and a fixing-sheet discharge roller 26 are mounted on the apparatus frame 24. The entrance guide 23 guides the recording materials so that the recording material P that has passed through a secondary transfer nip portion is correctly guided to the fixing nip portion N. According to the present exemplary embodiment, the entrance guide 23 is formed of polyphenylene sulfide (PPS) resin.

The pressing roller 22 is driven to rotate by a driving unit (not illustrated) at a predetermined peripheral speed in an anticlockwise direction indicated by an arrow illustrated in FIG. 2. When the pressing roller 22 rotates, the outer surface of the pressing roller 22 and the fixing sleeve 20 generates a press-contact frictional force at the fixing nip portion N. As a result, a rotational force is applied to the cylindrical fixing sleeve 20 by the press-contact frictional force, and the inner surface side of the fixing sleeve 20 becomes attached to and slides on the downward side of the heater 16. The fixing sleeve 20 is thus rotatably driven in a clockwise direction as indicated by an arrow illustrated in FIG. 2 around the heater holder 17. Grease is applied on the inner surface of the fixing sleeve 20 to ensure slidability between the heater holder 17 and the inner surface of the fixing sleeve 20.

When the pressing roller 22 starts to rotate, the cylindrical fixing sleeve 20 is rotatably driven. The heater 16 is then turned on, and the temperature thereof rises. While the temperature of the heater 16 has risen to and is adjusted to be at a predetermined temperature, the recording material P carrying an unfixed toner image is guided along the entrance guide 23 between the fixing sleeve 20 and the pressing roller 22 of the fixing nip portion N. The toner image carrying side of the recording material P becomes attached to the outer surface of the fixing sleeve 20 in the fixing nip portion N, and the recording material P is held and conveyed between the fixing nip portion N together with the fixing sleeve 20.

The heat from the heater 16 is applied to the recording material P via the fixing sleeve 20 in the holding and conveying process, so that the unfixed toner image on the recording material P is melted and fixed to the recording material P by the heat and pressure applied thereto. The recording material P which has passed through the fixing nip portion N is curvature-separated from the fixing sleeve 20, and discharged by the fixing-sheet discharge roller 26.

Figure 3A:
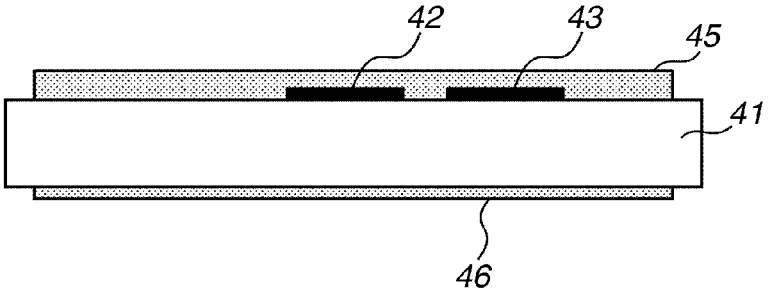
FIGS. 3A and 3B are a cross-sectional view and a plain view illustrating a heater according to the first exemplary embodiment.
Figure 3B:
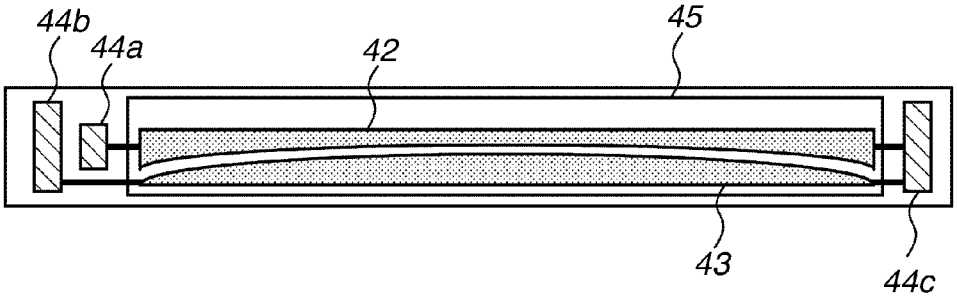

FIGS. 3A and 3B illustrate a cross-sectional view and a plain view of the heater 16 respectively. The heater 16 includes the following components.

(1) A ceramics substrate 41 which is a horizontally long flat plate, whose longitudinal direction is perpendicular to the sheet passing direction (according to the present exemplary embodiment, the lengths of the ceramic substrate 41 is 370 mm in the longitudinal direction and 10 mm in a short-length direction, and the thickness is 0.6 mm);

(2) resistive heating member layers (i.e., heating member patterns) 42 and 43 linearly or zonally coated along the longitudinal direction on one surface of the ceramic substrate 41 by screen printing, which generates heat by applying an electric current, the resistive heating member layers 42 and 43 are formed by applying electrically-conductive paste containing silver-palladium alloy (Ag/Pd) on the substrate 41, and the resistive heating member layers 42 and 43 are of approximately 10 μm thickness, 1 mm width, and 303 mm length;

(3) electrodes 44*a*, 44*b*, and 44*c* which are patterns for supplying electric power to the resistive heating member layers 42 and 43, formed by screen-printing silver paste on one surface of the ceramic substrate 41;

(4) thin glass coating 45 of approximately 30 μm thickness, to protect and ensure insulation of the resistive heating member layers 42 and 43; and (5) a sliding layer 46 formed of polyimide, disposed at locations which come into contact with the inner surface of the fixing sleeve 20, on the other surface of the ceramic substrate 41.

Figure 4:
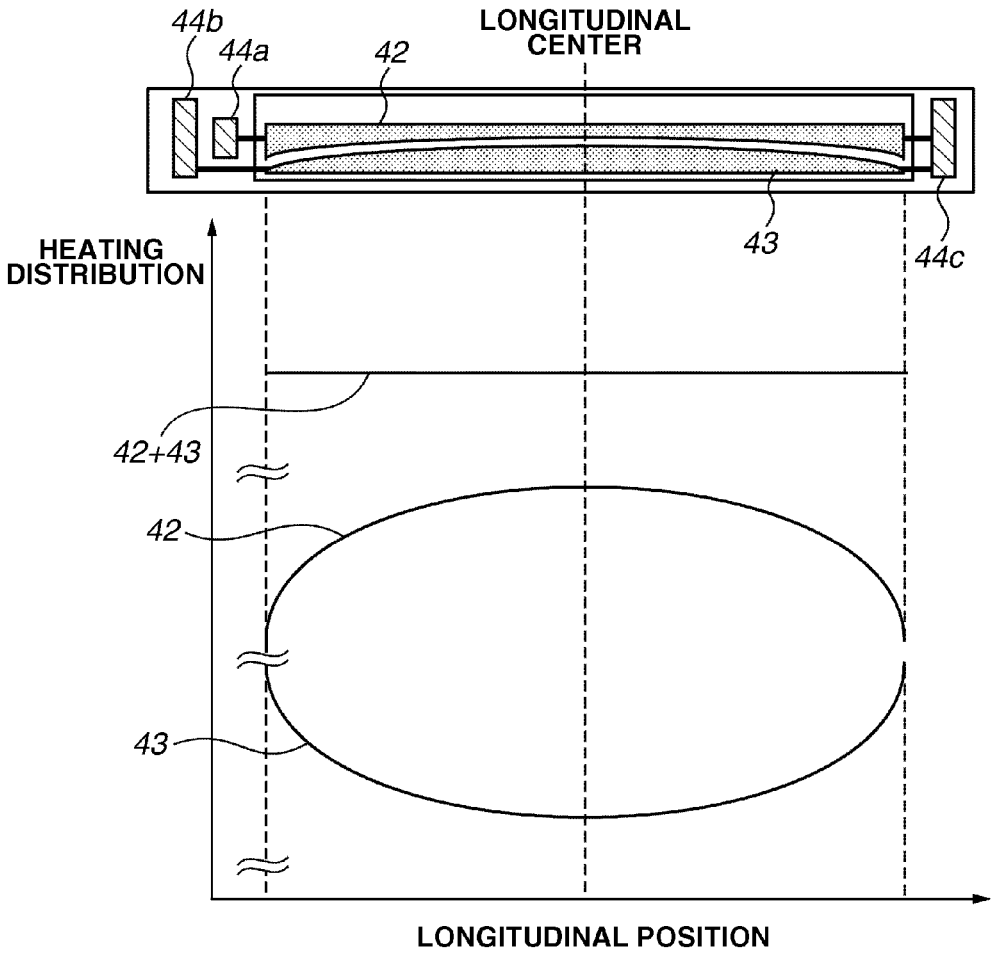
FIG. 4 is a schematic diagram illustrating a longitudinal heating distribution of the heater according to the first exemplary embodiment.

FIG. 4 illustrates a heating distribution of the heater 16 in the longitudinal direction, generated when supplying predetermined amount of power to the resistive heating member layers 42 and 43. The resistive heating member layer is formed of two heating members 42 (i.e., a first heating member pattern) and 43 (i.e., a second heating member pattern). The heating member 42 is formed so that a heat generation amount continuously decreases from a longitudinal center, i.e., the sheet-passing reference, to the edge portion (i.e., the heat generation amount per unit length gradually decreases). On the other hand, the heating member 43 is formed so that the heat generation amount continuously increases from the longitudinal center to the edge portion.

The electrode 44 (i.e., the electrodes 44*a*, 44*b*, and 44*c*) in the heater 16 are attached to a power-supply connector. The power is supplied from a heater driving circuit unit to the electrode 44 via the power supply connector, so that the resistive heating member layers 42 and 43 generate heat and the temperature of the heater 16 promptly rises.

According to the present exemplary embodiment, the electrode 44*c* is a common electrode that causes the heating member 42 to generate heat via the electrode 44*a*, and the heating member 43 to generate heat via the electrode 44*b*. Each of the heating members 42 and 43 are independently driven by a heater driving circuit (not illustrated). A time ratio to turn on the heating members 42 and 43 is controlled according to a paper size. As a result, a temperature rise in the portion of the fixing apparatus in which the sheet has not passed through can be effectively reduced while corresponding to the paper sizes whose width in the longitudinal direction is 76 mm to 297 mm.

In normal use, the fixing sleeve 20 starts to be rotatably driven when the pressing roller 22 starts to rotate, and the temperature of the inner surface of the fixing sleeve 20 also rises along with the temperature rise of the heater 16. Power supply to the heater 16 is controlled using proportional-integral-derivative (PID) control. Power input to the heater 16 is controlled so that the temperature of the inner surface of the fixing sleeve 20, i.e., the temperature detected by a sleeve thermistor 18 (a first temperature detection element), becomes a target value.

Referring to FIG. 2, a plate spring 25 presses the thermistor 18 against the inner surface of the fixing sleeve 20. A second temperature detection element 19 detects the temperature of the heater 16, and monitors the heater 16 to prevent an excessive rise in the temperature.

A control unit 21 controls supplying of power to the heater 16 according to the temperature detected by the first temperature detection element 18. A signal line of the second temperature detection element 19 is also connected to the control unit 21, and the control unit 21 stops supplying power to the heater 16 when the temperature of the heater 16 rises excessively.

According to the present exemplary embodiment, the fixing sleeve 20 is a cylindrical member (i.e., an endless belt) in which an elastic layer is formed on a belt-shaped member. More specifically, the fixing sleeve 20 includes a base layer which is a stainless (SUS) metal endless belt (i.e., a belt base member) formed into a cylindrical shape of 24 mm inner diameter and 30 μm thickness. A silicone rubber layer (i.e., the elastic layer) of approximately 300 μm thickness is formed on the base layer. Further, a PFA resin tube layer (i.e., an outermost layer) of 30 μm thickness is formed to cover the silicone rubber layer.

FIG. 5 illustrates the pressing mechanism according to the present exemplary embodiment. According to the present exemplary embodiment, the pressing mechanism applies a spring force of a pressing spring 81 to the external surface of the pressing roller 22 via a pressing plate 82, a flange 83, the heater holder 17, the heater 16, and the fixing sleeve 20. More specifically, the pressing spring 81 disposed between the fixing frame 24 and the pressing plate 82 presses the flange 83 that supports the heater folder 17 from both of the longitudinal sides, towards the pressing roller 22 via the heater 16 and the fixing sleeve 20.

A cam member 84 is a part of the pressure adjustment mechanism. The cam members 84 are disposed facing to the pressing spring 81 across the pressing plate 82, in the near side and the far side of the pressing plate 82 with respect to FIGS. 5A, 5B, and 5C. The cam members 84 in the near side and the far side are of the same size and shape, and are fixed to a camshaft 85 in the same phase. The camshaft 85 is supported by a bearing to freely rotate, and is rotated and stopped by a motor (not illustrated).

Figure 5A:
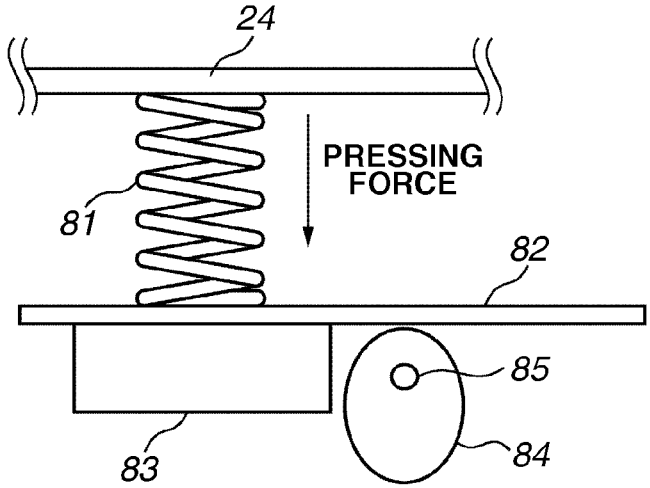
FIGS. 5A, 5B, and 5C illustrate a pressing mechanism and statuses in each fixing mode.

Referring to FIG. 5A, the cam member 84 is not in contact with the pressing plate 82, so that the maximum pressing force is applied on the fixing nip portion (i.e., a first pressing state). According to the present exemplary embodiment, the total pressing force in the first pressing state is 294 N (30 kgf).

Figure 5B:
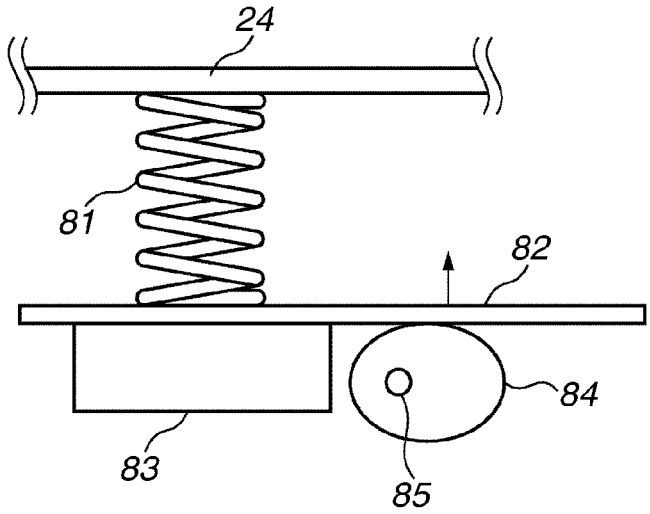

If the camshaft 85 is then rotated 90° from the state illustrated in FIG. 5A, the cam member 84 moves and the state becomes as illustrated in FIG. 5B. The pressing plate 82 is thus pushed up, and the pressing force applied on the fixing nip portion can be set lower than in the first pressing state (i.e., a second pressing state). According to the present exemplary embodiment, the total pressing force in the second pressing state is 147 N (15 kgf).

Figure 5C:
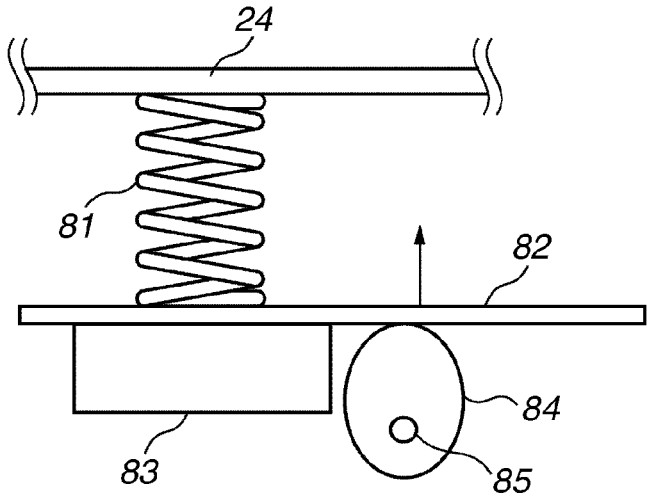

If the cam shaft 85 is further rotated 90° from the state illustrated in FIG. 5B, the cam member 84 also moves and the state becomes as illustrated in FIG. 5C. The pressing plate 82 is thus further pushed up, and the pressing force can be set even lower (i.e., a third pressing state).

According to the present exemplary embodiment, a case where a regular size paper commonly used in the office is to be printed will be referred to as normal printing. In the normal printing, fixing processing is performed in a first fixing mode (i.e., the pressing force applied to the fixing nip portion is set to a first pressing force). Further, if an envelope whose width in the longitudinal direction is comparatively narrow is to be printed on, fixing processing is performed in a second fixing mode (i.e., the pressing force applied to the fixing nip portion is set to a second pressing force). This is to prevent wrinkles from occurring. Further, if a paper jam is to be treated, or the power of the main body is to be switched off, the state is set to the third pressing state.

As described above, the fixing apparatus includes the heater, the belt member of which the inner peripheral surface is in contact with the heater, and the back-up member forming the fixing nip portion that performs fixing processing on the recording material along with the heater via the belt member. The fixing apparatus further includes the pressure adjustment mechanism that is capable of setting the pressing force applied to the fixing nip portion to the first pressing force and to the second pressing force that is lower than the first pressing force. The fixing apparatus is capable of executing the first fixing mode that performs fixing processing at the first pressing force, and the second fixing mode that performs fixing processing at the second pressing force.

Figure 6A:
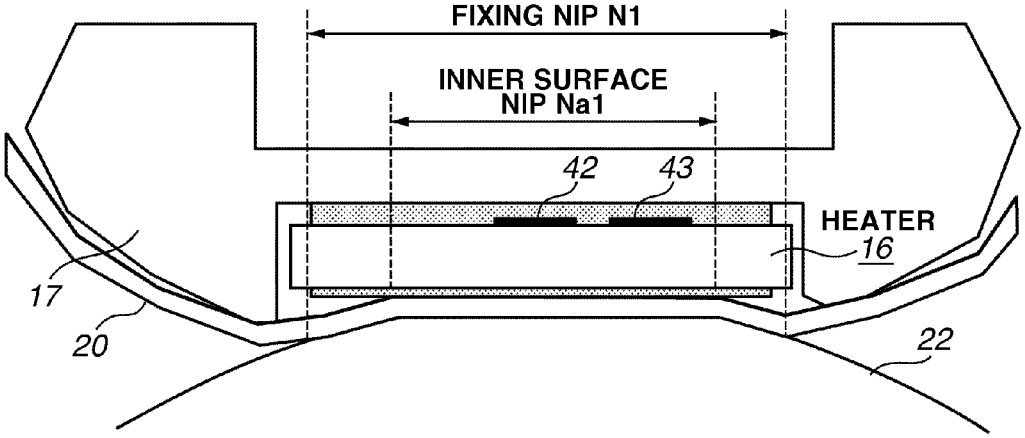
FIGS. 6A and 6B illustrate areas surrounding an inner surface nip portion according to the first exemplary embodiment.
Figure 6B:
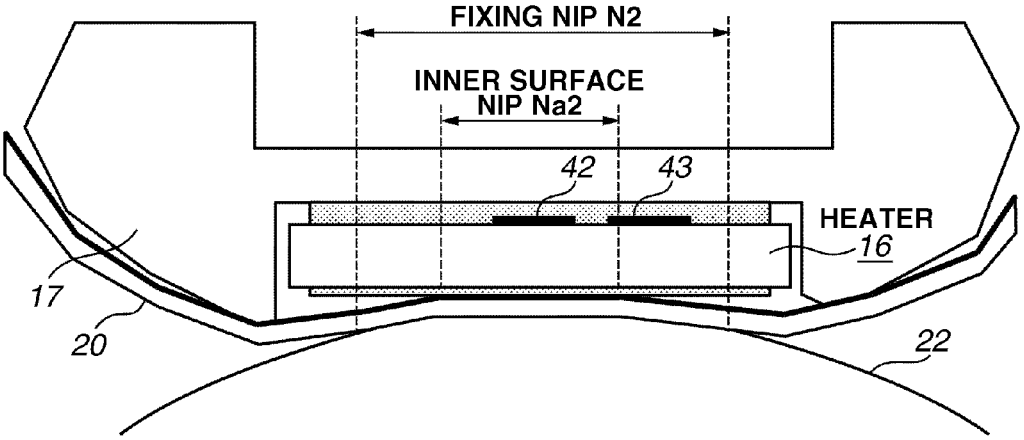

FIGS. 6A and 6B illustrate areas surrounding the nip portion in the fixing apparatus 12 according to the present exemplary embodiment. Referring to FIGS. 6A and 6B, the nip portion in the fixing apparatus 12 includes an inner surface nip portion Na and a fixing nip portion N. The inner surface nip portion Na is the press-contacting portion between the heater 16 and the fixing sleeve 20, and is a heat transfer channel from the heater 16 to the fixing sleeve 20 (i.e., a contact region between the heater and the belt member). The fixing nip portion N is the press-contacting portion between the fixing sleeve 20 and the pressing roller 22. Ranges of the regions of the inner nip portion Na and the fixing nip portion N are determined by a positional relationship between the heater 16 and the heater holder 17, the rigidity of the fixing sleeve 20, the elasticity of the pressing roller 22, and the pressing force generated by the above-described pressing mechanism.

If a fixing sleeve whose base member is SUS is to be used, such as the fixing sleeve 20 according to the present exemplary embodiment, the fixing sleeve forms a curvature-shaped nip portion as illustrated in FIG. 6, due to the rigidity thereof. Thus, generally, the range of the region of the fixed nip portion N is narrower than the range of the region of the inner surface nip portion Na.

FIG. 6A illustrates the positional relationship between an inner surface nip portion Na1 and surrounding members in the first fixing mode. Referring to FIG. 6A, all of the heating members 42 and 43 of the heater 16 are contained within the range of the region of the inner surface nip portion Na1 in the first fixing mode.

According to the present exemplary embodiment, the width of the inner surface nip portion Na 1 is 5 mm, and the width of the fixing nip portion N1 is 9 mm. The fixing nip portion N1 and the inner surface nip portion Na1 are each positioned to be approximately symmetrical with respect to the center of the nip portion. Further, the width of each of the heating members 42 and 43 of the heater 16 is approximately 1 mm, and a distance between the heating members 42 and 43 is 0.5 mm. According to the present exemplary embodiment, a shortest distance between the heating member 43 and a boundary of the inner surface nip portion Na1 is 0.5 mm.

FIG. 6B illustrates the positional relationship between an inner surface nip portion Na2 and the surrounding members in the second fixing mode. Referring to FIG. 6B, all of the heating member 42 of the heater 16 is contained within the range of the region of the inner surface nip portion Na2 in the second fixing mode. Further, a portion or the entire heating member 43 is disposed outside the inner surface nip portion Na2.

According to the present exemplary embodiment, the width of the inner surface nip portion Na2 is 3 mm, and the width of the fixing nip portion N2 is 6 mm. The fixing nip portion N2 and the inner surface nip portion Na2 are each positioned to be approximately symmetrical with reference to the center of the nip portion. Further, the widths of the heating members 42 and 43 of the heater 16 are each approximately 1 mm, and the distance between the heating members 42 and 43 is 0.5 mm. The heating member 43 is disposed 0.8 mm away from the inner surface nip portion Na2.

As described above, the heater includes the first heating member pattern and the second heating member pattern. When the pressing force applied on the fixing nip portion is set to the first pressing force, all of the first heating member pattern and the second heating member pattern are contained within the contact region between the heater and the belt member. When the pressing force applied on the fixing nip portion is set to the second pressing force, the entire first heating member pattern is contained within the contact region between the heater and the belt member. However, at least a portion of the second heating member pattern is disposed outside the contact region.

Heating control of the heater 16 performed in each fixing mode will be described below.

(1) First Fixing Mode

In the case of the first fixing mode which is set in normal printing, both of the heating members 42 and 43 of the heater 16 are turned on, so that the heating distribution in the longitudinal direction becomes approximately flat. Printing is then performed. All of the heating members 42 and 43 are contained within the range of the region of the inner surface nip portion Na1. The heat generated by the heating members 42 and 43 is thus efficiently transferred to the fixing sleeve 20 via the inner surface nip portion Na1, and then to the recording material P, and the toner image T on the recording material P is fixed.

(2) Second Fixing Mode

In the case of the second fixing mode which is set when printing on the envelope, the heating member 42 is turned on and the heating member 43 is turned off, so that the heating distribution in the longitudinal direction is high at the center. Printing is then performed. The entire heating member 42 is contained within the range of the region of the inner surface nip portion Na2. The heat generated by the heating member 42 is thus efficiently transferred to the fixing sleeve 20 via the inner surface nip portion Na2, and then to the recording material P, i.e., the envelope. On the other hand, a portion or the entire heating member 43 is disposed outside the inner surface nip portion Na2. If the heating member 43 generates heat at a turn-on time ratio similar to that of the heating member 42 in such a state, the heat outside the inner surface nip portion Na2 of the heater is not efficiently transferred to the fixing sleeve 20. The ratio of heat transferred to the heater 16 and the heater 17, i.e., the components other than the recording material P, thus increases. As a result, the percentage of the heat amount contributing to fixing of the toner becomes small with respect to the heat generation amount of the heater, so that heat efficiency is lowered. According to the present exemplary embodiment, since the heating member 43 outside the inner surface nip portion Na2 is not turned on, the heat efficiency is hardly lowered.

Table 1 compares control temperature of the thermistor 18, occurrence frequency of wrinkles on the envelope, and average consumed power of the fixing apparatus for fixing the toner image T on the envelope for various combinations of each fixing mode and heating control. The envelope is printed in an environment in which atmosphere temperature is 30° C. and relative humidity is 80%.

TABLE 1

| | Pressing force | Heating member 42 | Heating member 43 | Fixing temp. | Wrinkle on envelope | Consumed power |
|---|---|---|---|---|---|---|
| Exemplary embodiment 1 | 147N | ON | OFF | 160° C. | 0% | 600 W |
| Comparison example 1 | 294N | ON | ON | 150° C. | 20% | 800 W |
| Comparison example 2 | 147N | ON | ON | 160° C. | 0% | 800 W |

As illustrated in table 1, the wrinkles are not generated in the envelope according to the first exemplary embodiment, and the consumed power is also reduced. In contrast, since the envelope is passed through the fixing apparatus at high pressing force in the comparison example 1, the wrinkles are easily generated in the envelope. In the case of the comparison example 2, the pressing force is reduced, so that the wrinkles are not generated in the envelope. However, since it is difficult for the heat to be transferred from the heating member 43 to the envelope, the heat efficiency is low, and the consumed power cannot be reduced.

According to the present exemplary embodiment, when low pressing force is applied in performing fixing, the heating members are disposed with respect to the inner surface nip portion and the heat control is performed as described above. As a result, the occurrence frequency of the wrinkles in the envelope and fixing heat efficiency are both improved when applying low pressing force. According to the present exemplary embodiment, the heating members 42 and 43 of the heater 16 are disposed the opposite side to the inner surface nip portion Na with respect to the base member 41 (i.e., back surface heating is performed). However, the present invention is not limited to this configuration, and the heating members 42 and 43 may be disposed on the same side as the inner surface nip portion Na with respect to the base member 41 (i.e., front surface heating may be performed).

Further, according to the present exemplary embodiment, heating control is performed in the second fixing mode without turning on the heating member 43. However, if the turn-on time of the heating member 43 is shortened with respect to the turn-on time of the heating member 42, a similar effect can be achieved. Further, various modifications within the technological scope may be performed.

The effect achieved in the present invention may also be realized according to a second exemplary embodiment to be described below. A fixing apparatus according to the present exemplary embodiment branches a heating member 53, i.e., a second heating member pattern of a heater 50 into two. The second heating member pattern 53 is then each disposed at an upstream position and a downstream position in a recording material conveying direction with respect to a heating member 52. Other configurations are similar to those of the first exemplary embodiment, and detailed description will thus be omitted.

Figure 7A:
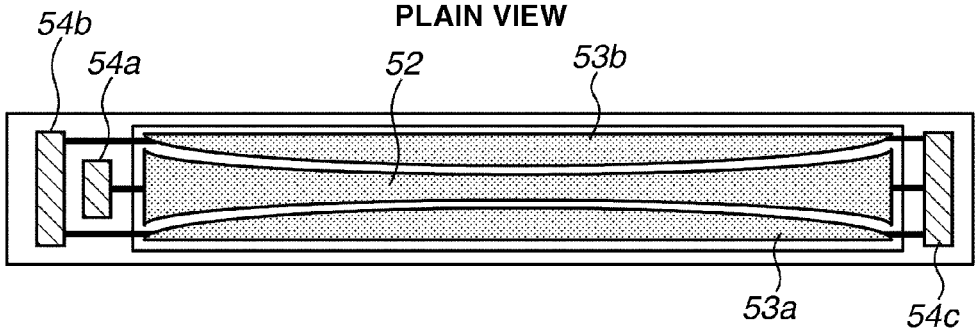
FIGS. 7A, 7B, and 7C illustrate a plain view of a heater and areas surrounding an inner surface nip portion according to a second exemplary embodiment.
Figure 7B:
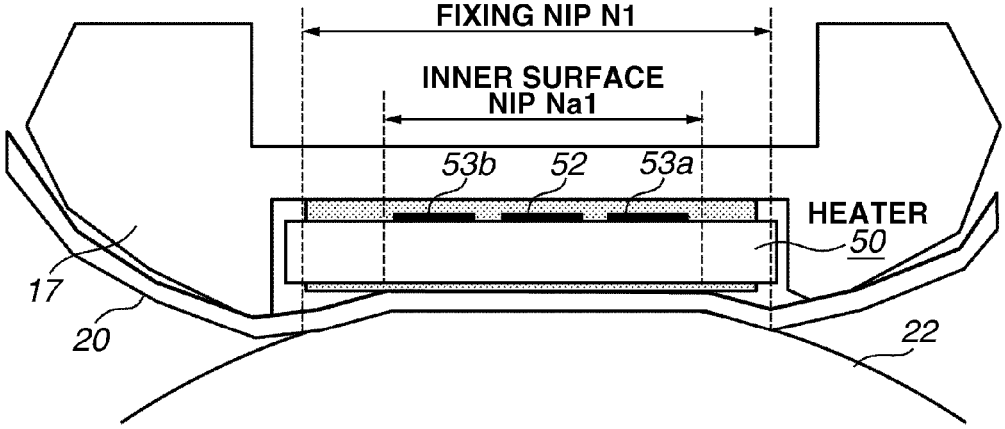
Figure 7C:
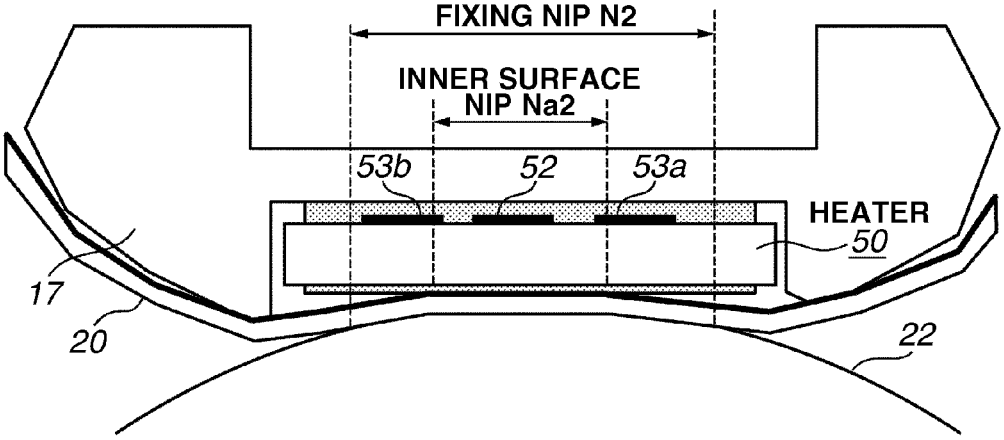

FIGS. 7A, 7B, and 7C are a plain view of the heater 50 and schematic cross-sectional views of areas surrounding nip portions according to the present exemplary embodiment. Referring to FIGS. 7A, 7B, and 7C, the heating members 52 and 53 (53*a* and 53*b*) are disposed on the heater 50 as described below. The heating members 53*a* and 53*b* which are formed so that the heat generation amount continuously increases from the longitudinal center to the edge portion are formed as parallel circuits. The heating members 53*a* and 53*b* are disposed at the upstream position and the downstream position of the heating member 52 formed so that the heat generation amount continuously decreases from the longitudinal center to the edge portion.

The positional relationship between the inner surface nip portion Na and the heating members 52 and 53 are illustrated in FIGS. 7B and 7C. In the first fixing mode illustrated in FIG. 7B, all of the heating members 52, 53*a*, and 53*b* of the heater 50 are contained within the range of the region of the inner surface nip portion Na1. In the second fixing mode illustrated in FIG. 7C, the entire heating member 52 is contained within the range of the region of the inner surface nip portion Na2, and a portion or all of the heating members 53*a* and 53*b* is disposed outside the inner surface nip portion Na2.

According to the present exemplary embodiment, the width of the inner surface nip portion Na1 is 5 mm, the widths of the heating members 52, 53*a*, and 53*b* are each approximately 1 mm, the distance between the heating members is 0.5 mm, and the shortest distance from the heating members 52, 53*a*, and 53*b* to a boundary of the inner surface nip portion Na1 is 0.5 mm. According to the second fixing mode, the width of the inner surface nip portion Na2 is 3 mm, the widths of the heating members 52, 53*a*, and 53*b* are each approximately 1 mm, the distance between the heating members is 0.5 mm, and the heating members 53*a* and 53*b* are disposed 0.75 mm away from the inner surface nip portion Na2.

Methods for driving the heating members 52 and 53 (53*a* and 53*b*) in each fixing mode are similar to those according to the first exemplary embodiment. More specifically, the heating members 52, 53*a*, and 53*b* can be independently turned on via electrodes 54*a*, 54*b*, and 54*c* illustrated in FIG. 7A.

According to the present exemplary embodiment, the heat from the heating members 52 and 53 can be transferred to a wide range within the region of the inner surface nip portion Na1 in the first fixing mode by branching the heating members. As a result, the heat efficiency can be improved in the first fixing mode. Further, in the second fixing mode in which the pressing force is reduced, a similar effect as in the first exemplary embodiment can be achieved. According to the present exemplary embodiment, the heating members 53*a* and 53*b* are formed as the parallel circuits. However, the present invention is not limited to this configuration, and the heating members 53*a* and 53*b* may also be formed as serial circuits.

The effect acquired in the present invention may also be realized according to a third exemplary embodiment to be described below. According to the present exemplary embodiment, a normal printing heating member 62 and an envelope printing heating member 63 are formed as the heating members of a heater 60 in the fixing apparatus. The other configurations are similar to those of the first exemplary embodiment, and detailed description will thus be omitted.

Figure 8A:
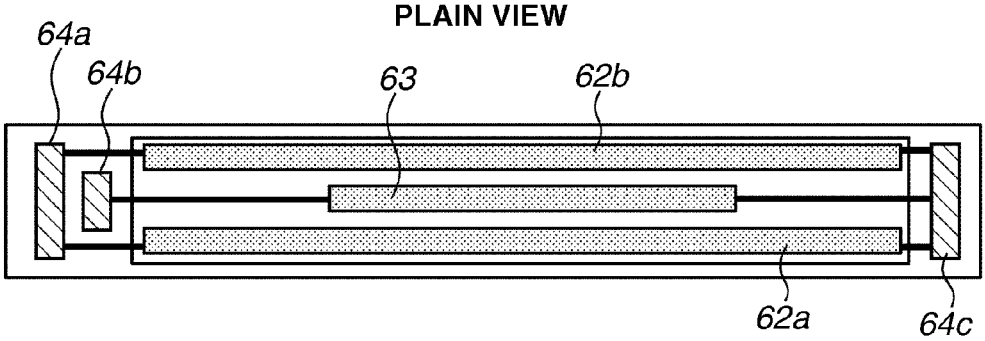
FIGS. 8A, 8B, and 8C illustrate a plain view of a heater and areas surrounding an inner surface nip portion according to a third exemplary embodiment.
Figure 8B:
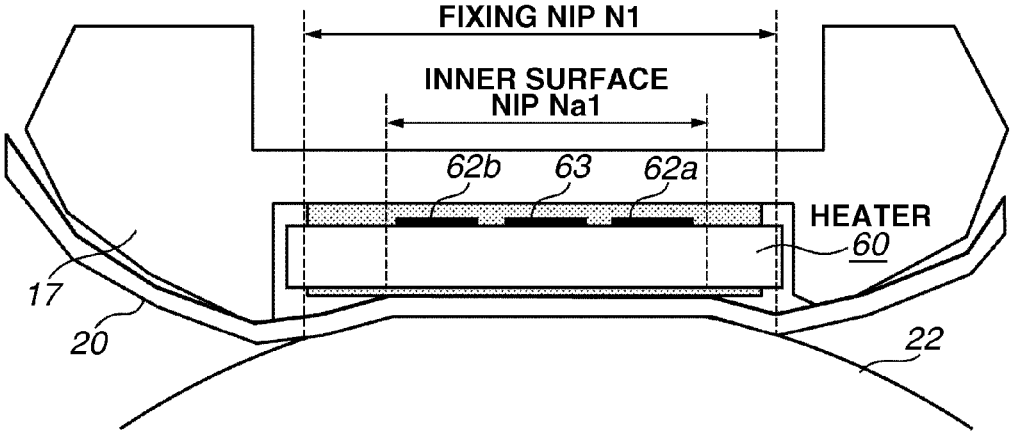
Figure 8C:
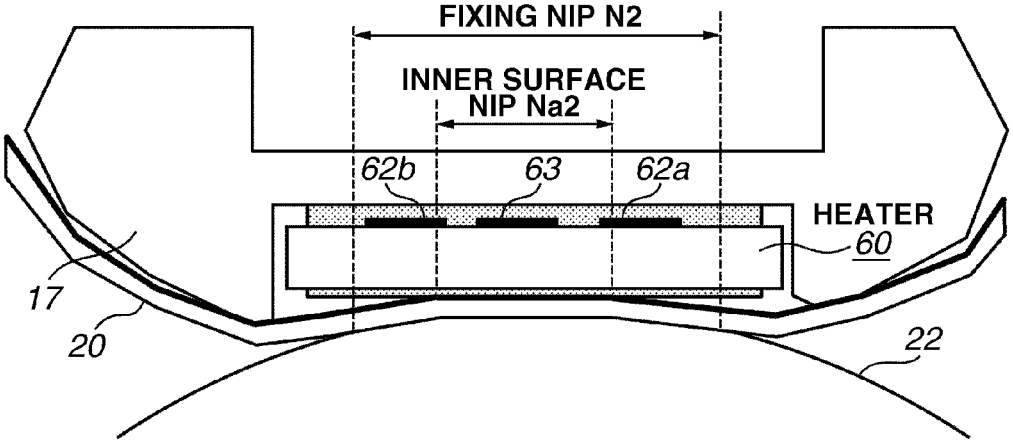

FIG. 8A is a plain view illustrating the heater 60 according to the present exemplary embodiment. Referring to FIG. 8A, the normal printing heating member 62 (i.e., 62*a* and 62*b*) is disposed to generate heat so that the heating distribution becomes approximately flat in the longitudinal direction. According to the present exemplary embodiment, the normal printing heating member 62 is formed so that the length in the longitudinal direction is 303 mm, which is sufficient to fix an image on A3 size paper of width 297 mm. On the other hand, the envelope printing heating member 63 is formed so that the length in the longitudinal direction is shortened. According to the present exemplary embodiment, the length of the envelope printing heating member 63 with respect to the longitudinal center, i.e., the sheet-passing reference, is 182 mm, which is sufficient to fix an image on a B5 size envelope of width 176 mm. The methods for driving the heating members 62 (62*a* and 62*b*) and 63 in each fixing mode are similar to those according to the first exemplary embodiment. More specifically, the heating members 62*a*, 62*b*, and 63 can be independently turned on via electrodes 64*a*, 64*b*, and 64*c* illustrated in FIG. 8A.

The heating control of the heating members 62*a*, 62*b*, and 63 is performed in each fixing mode as follows. In the first fixing mode, i.e., normal printing, the normal printing heating member 62 is used, and in the second fixing mode, i.e., envelope printing in which the pressing force is reduced, the envelope printing heating member 63 is used.

According to the present exemplary embodiment, the length of the envelope printing heating member 63 in the longitudinal direction is shortened to correspond to the width of the envelope. As a result, a region which is uselessly heated in a non-sheet passing portion of the envelope can be reduced in the second fixing mode, in which the pressing force is reduced when the envelope is passed through, so that the power consumption in the second fixing mode can be further reduced.

Figure 9:
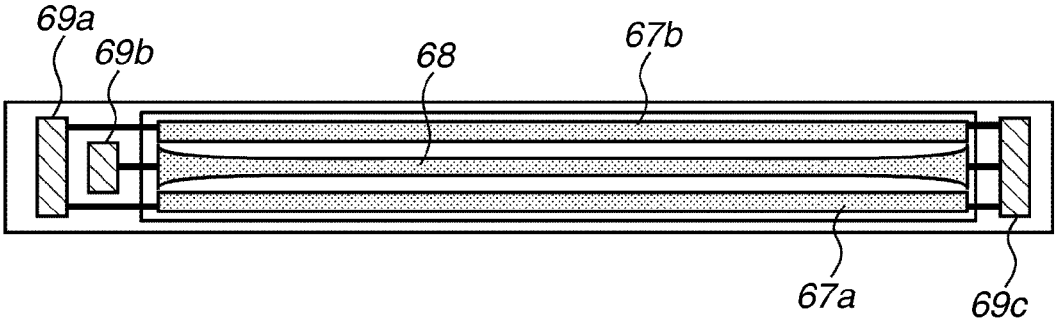
FIG. 9 illustrates another example of the heater according to the third exemplary embodiment.

According to the present exemplary embodiment, the longitudinal center is set as the sheet-passing reference. However, the present invention is not limited to this configuration, and the present invention may be applied when the longitudinal edge portion is set as the sheet-passing reference by disposing the heating members in the longitudinal direction accordingly. Further, FIG. 9 illustrates a heater 65 according to the present exemplary embodiment including a heating member 68 exclusively for an envelope in which the heat generation amount decreases from the sheet-passing reference to the longitudinal edge portion.

The effect acquired in the present invention may also be realized according to a fourth exemplary embodiment to be described below. According to the present exemplary embodiment, a normal printing heating member 72 and a curl prevention heating member 73 are formed as the heating members of a heater 70 in the fixing apparatus. The other configurations are similar to those according to the first exemplary embodiment, and detailed description will thus be omitted. According to the present exemplary embodiment, the first fixing mode is a normal processing mode for processing the recording material of a normal thickness, and the second fixing mode is a curl reduction mode for processing a thin recording material.

Figure 10A:
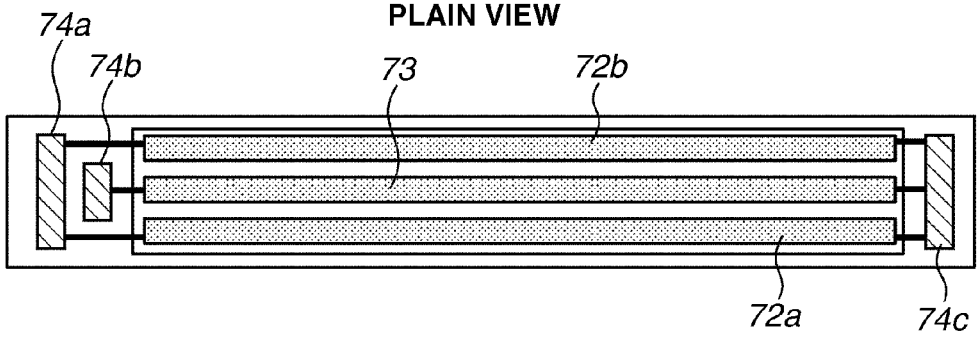
FIGS. 10A, 10B, and 10C illustrate a plain view of a heater and areas surrounding an inner surface nip portion according to a fourth exemplary embodiment.
Figure 10B:
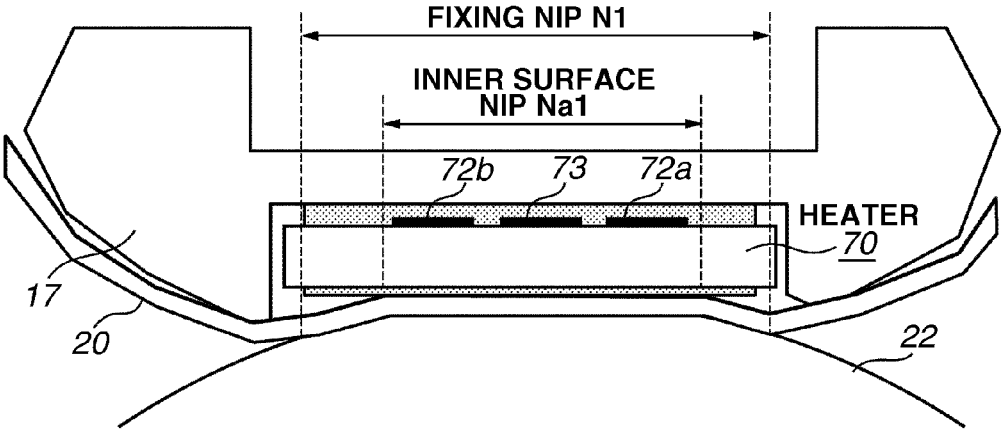
Figure 10C:
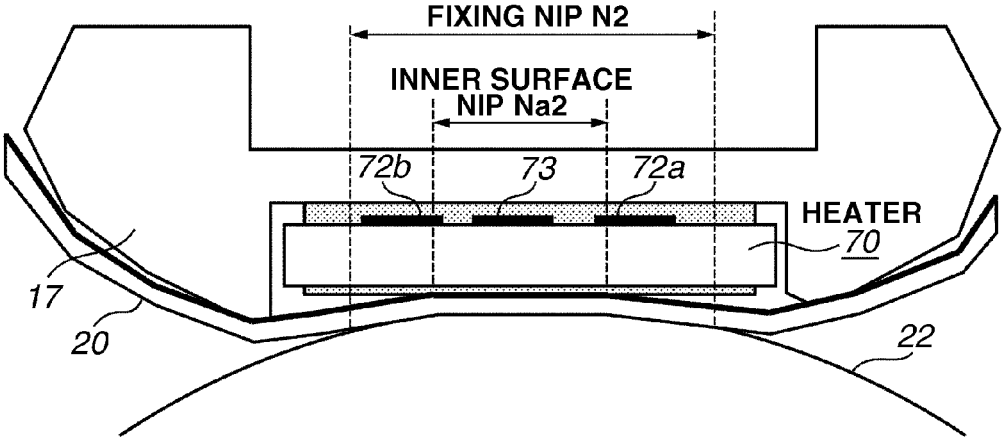

FIG. 10A is a plain view illustrating the heater 70 according to the present exemplary embodiment. Referring to FIG. 10A, both the normal printing heating member 72 and the curl prevention heating member 73 of the heater 70 according to the present exemplary embodiment have approximately flat heating distribution in the longitudinal direction.

Further, according to the present exemplary embodiment, the second fixing mode which is of reduced pressing force is employed as a curl prevention mode (i.e., the curl reduction mode) set when using the recording material that easily becomes curled, such as thin paper. The range of the region of the fixing nip portion N2 in the second fixing mode is set narrower than the fixing nip portion N1 in the first fixing mode, so that excessive heat is reduced from being supplied to the recording material P. The deformation of the recording material P caused by passing through the fixing apparatus, i.e., curling, can thus be prevented. According to the present exemplary embodiment, the width of the fixing nip portion N1 is 9 mm, and the width of the fixing nip portion N2 is 6 mm.

The methods for driving the heating members 72 (72*a* and 72*b*) and 73 in each fixing mode are similar to those according to the first exemplary embodiment. More specifically, the heating members 72 and 73 can be independently turned on via electrodes 74*a*, 74*b*, and 74*c* illustrated in FIG. 10A. In the first fixing mode, i.e., the normal paper printing mode, only the heating member 72 or both the heating members 72 and 73 are turned on in performing heating control. In the second fixing mode of lower pressing force, i.e., the curl prevention mode for thin paper, the heating member 73 is turned on.

According to the present exemplary embodiment, the second fixing mode of lower pressing force is employed as the curl prevention mode for performing fixing on thin paper. Further, the heating member 72 of which a portion or the entirety is disposed outside the inner surface nip portion Na2 is not turned on. The heat efficiency in the curl prevention mode is thus prevented from becoming lowered.

According to the present exemplary embodiment, the normal printing heating members 72*a* and 72*b* are disposed in both the upstream position and the downstream position of the curl prevention heating member 73. However, the present invention is not limited to this configuration, and the normal printing heating member 72 may be disposed on either the upstream position or the downstream position of the curl prevention heating member 73. Other various modifications within the technological scope may also be performed. Further, according to the present exemplary embodiment, only the heating member 73 is turned on in the second fixing mode. However, the present invention is not limited to this configuration, and a similar effect can be achieved even when both the heating members 72 and 73 are turned on, and the turn-on time ratio of the heating member 72 is reduced as compared to the first fixing mode.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-252471 filed Nov. 11, 2010, which is hereby incorporated by reference herein in its entirety.

What is claimed is:

1. A fixing apparatus comprising:

a heater;

a belt member to which the heater is in contact with on an inner circumferential surface;

a back-up member configured to form a fixing nip portion with the heater via the belt member for performing fixing processing on a recording material; and a pressure adjustment mechanism configured to be capable of setting a pressing force to be applied to the fixing nip portion to a first pressing force and a second pressing force that is lower than the first pressing force, wherein the fixing apparatus is capable of executing a first fixing mode in which fixing processing is performed at the first pressing force and a second fixing mode in which fixing processing is performed at the second pressing force, and wherein the heater includes a first heating member pattern and a second heating member pattern, and if the first pressing force is set to the pressing force to be applied to the fixing nip portion, all of the first heating member pattern and the second heating member pattern are contained within a contact region between the heater and the belt member, and if the second pressing force is set to the pressing force to be applied to the fixing nip portion, all of the first heating member pattern is contained within the contact region and at least a portion of the second heating member pattern is disposed outside the contact region.

2. The fixing apparatus according to claim 1, further comprising a control unit configured to control power to be supplied to the heater, wherein the control unit performs control in the second fixing mode so that turn-on time of the second heating member pattern becomes shorter than turn-on time of the first heating pattern, or the second heating pattern is not turned on.

3. The fixing apparatus according to claim 1, wherein a heating distribution of the first heating member pattern in a direction perpendicular to a conveying direction of the recording material is a heating distribution in which heat generation amount per unit length gradually decreases from a sheet-passing reference to an edge portion of a recording material.

4. The fixing apparatus according to claim 1, wherein a length of the first heating member pattern in a direction perpendicular to a conveying direction of the recording material is shorter than a length of the second heating member pattern.

5. The fixing apparatus according to claim 1, wherein the first fixing mode is a mode for using plain paper as a recording material, and the second fixing mode is a mode for using an envelope as a recording material.

6. The fixing apparatus according to claim 1, wherein the first fixing mode is a normal processing mode, and the second fixing mode is a curl reduction mode.

* * * * *